US006189157B1

(12) United States Patent
Ziegler

(10) Patent No.: US 6,189,157 B1
(45) Date of Patent: Feb. 20, 2001

(54) FABRIC, ESPECIALLY PIERCE-PROOF FABRIC

(75) Inventor: Bruno Ziegler, Illingen (DE)

(73) Assignee: Ziegler Mechanische Werkstatt, Metallgewebe und Arbeitsschutz GmbH, Illigen (DE)

( * ) Notice: Under 35 U.S.C. 154(b), the term of this patent shall be extended for 0 days.

(21) Appl. No.: 09/302,420

(22) Filed: Apr. 30, 1999

(30) Foreign Application Priority Data

May 4, 1998 (DE) ..... 198 19 737

(51) Int. Cl.[7] ..... A41D 13/12

(52) U.S. Cl. ..... 2/455; 2/456; 2/2.12; 2/2.15; 2/2.5; 2/222; 442/134; 442/316; 428/52; 428/53; 428/54; 428/60; 428/911; 428/912

(58) Field of Search ..... 428/52, 53, 54, 428/60, 911, 912; 442/134, 316; 2/455, 456, 2.12, 2.15, 2.5, 222

(56) References Cited

U.S. PATENT DOCUMENTS 4,442,150 * 4/1984 Greiner et al. ..... 428/53
5,088,123 2/1992 MacDonald .
5,306,532 * 4/1994 Tsien et al. ..... 428/33
5,601,895 * 2/1997 Cunnihgham ..... 428/66.6
5,853,863 * 12/1998 Kim ..... 428/223

FOREIGN PATENT DOCUMENTS

3039520 A1 5/1982 (DE) .
2287639 * 5/1992 (GB) ..... F41H/5/04
WO 92/08094 * 5/1992 (WO) ..... F41H/1/02
WO93/21492 * 10/1993 (WO) ..... F41H/31/00
WO95/09033 * 3/1995 (WO) ..... A41D/13/04

* cited by examiner

*Primary Examiner*—Terrel Morris
*Assistant Examiner*—Arti R. Singh
(74) *Attorney, Agent, or Firm*—Rabin & Champagne, PC

(57) ABSTRACT

A fabric, which can be used more especially as a pierce-proof fabric but also as a decorative fabric, includes a plurality of interconnected scales, which have bores to connect them to one another, and into which connecting members extend. The connecting members are directly formed on the scales. Because the scales overlap one another in the manner of roof tiles (form an imbrication) and because, in order to make a flat connection, the scale itself in the fabric overlaps at least two adjacent scales and is overlapped by at least two additional adjacent scales, the fabric can also meet increased safety requirements in an advantageous manner.

25 Claims, 2 Drawing Sheets

FABRIC, ESPECIALLY PIERCE-PROOF FABRIC

FIELD OF THE INVENTION

The invention relates to a fabric, especially a pierce-proof fabric comprising a plurality of interconnected scales which have the same basic shape, and bores to connect them to one another. The scales further have connecting members which extend into the bores of an adjacent scale, and which are formed directly on the scales. The fabric can, however, also be used for other purposes, e.g. as a decorative fabric.

BACKGROUND INFORMATION

Patent DE 30 39 520 A1 discloses a fabric in which the scales of the different rows are connected to the scales of the adjacent rows. A flat connection with simultaneous overlapping in the manner of roof tiles (forming an imbrication) is not realized there, since the individual scales at best push against, rather than overlap, one another in the respective row. Therefore, since a sharp object could penetrate such arranged scales by being inserted between the adjacent, non-overlapping scales, it is necessary, in order to obtain armor-plating, for the fabric to be embedded in additional material, or for even a plurality of fabrics to have to be disposed one behind the other. Only then can this fabric really provide sufficient resistance to being pierced. However, this leads to a considerable increase in weight of a pierce-proof fabric manufactured in this way.

As pierce-proof fabrics for protecting people, fabrics are also known which are produced by means of the scales being provided with bores and the individual scales then being interconnected by means of wire. This type of manufacture involves a relatively large outlay; however it meets at least the safety requirements in Europe.

As additional pierce-proof fabrics, protective wire fabrics which comprise a large number of interconnected rings are used, for example, in the butchery trade.

However in many countries, requirements exist which are not met by any of these fabrics. It is required that the pierce-proof fabrics also offer protection against stickle-backs and ice axes, which can penetrate the previously known fabrics unhindered.

SUMMARY OF THE INVENTION

Proceeding from this state of the art, the present invention proposes to solve the aforementioned problems by creating a fabric which is easy to manufacture and also meets increased safety requirements.

This problem is solved by a fabric comprising a plurality of interconnected scales, these scales being arranged in the manner of roof tiles with each scale overlapping at least two adjacent scales. The scales comprise bores and connecting members for interconnecting the scales.

In this fabric, the scales are no longer interconnected via separate connecting members, such as wire rings, for example. Instead of this, the connecting members are formed directly on the scales, such that overlapping of the scales arises of its own accord when the different scales are connected. In this way it is no longer possible for stickle-backs to pass through between the scales. The only parts which could perhaps be penetrated are the bores into which the connecting members extend. However, the bores' diameters can be so adapted to the respective requirements that practically no further risk remains. The connecting members themselves are manufactured from the same material as the scales so that they also cannot be bent open easily, even if an attacker tries to penetrate the fabric by force. However, through the interplay between the bore and the connecting member, sufficient mobility is produced.

The fabric is also suitable for other areas of use such as, for example, in the ornamental or decorative field. Not only is there an aesthetic, largely closed exterior, but as a result of the very extensive mobility, this fabric can be used for many purposes, such as a wrist strap or as a basic material for manufacturing bags.

BRIEF DESCRIPTION OF THE FIGURES

The invention is explained in greater detail below with the aid of embodiments, given by way of example. The figures show.

DESCRIPTION OF PREFERRED EMBODIMENTS

The invention is now explained in greater detail, by way of example, with reference to the attached drawings. However, the embodiments are only examples which are not intended to limit the inventive concept to a specific physical arrangement.

Figure 1:
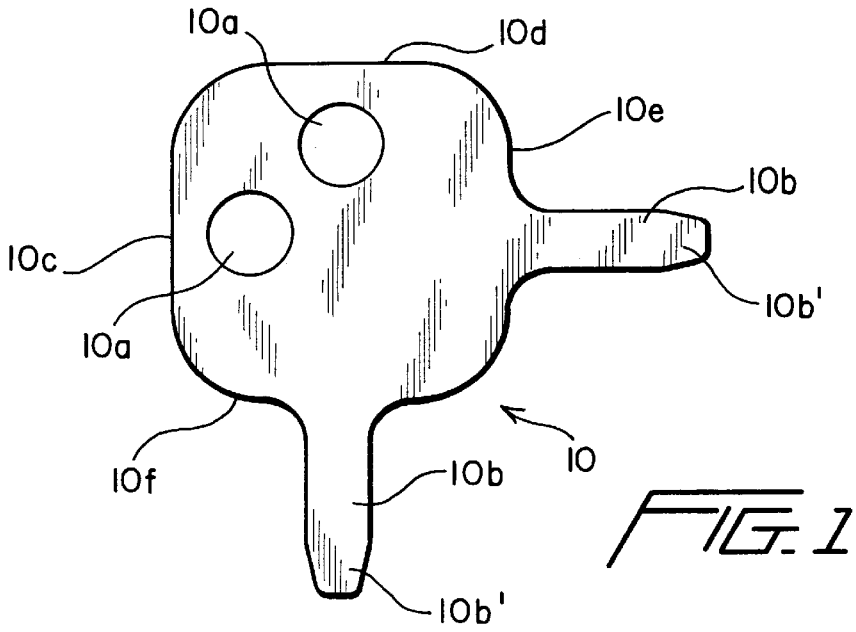
FIG. 1 a view of an individual scale.
Figure 2:
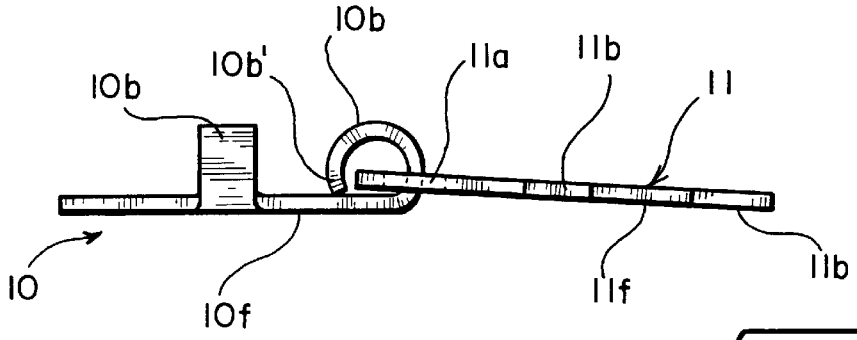
FIG. 2 two interconnected scales.
Figure 4:
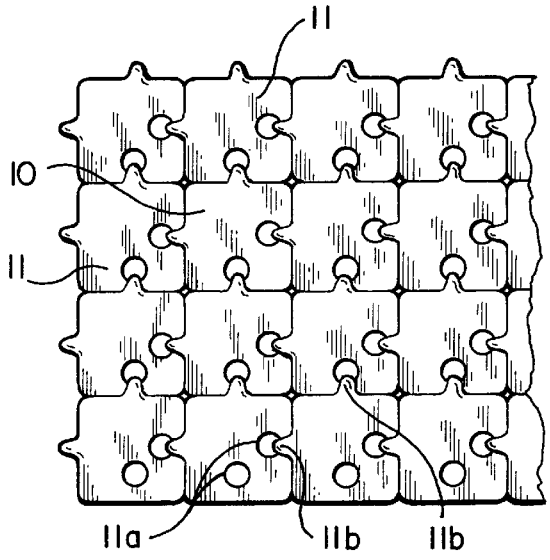
FIG. 4 a view of the fabric from the exterior.
Figure 5:
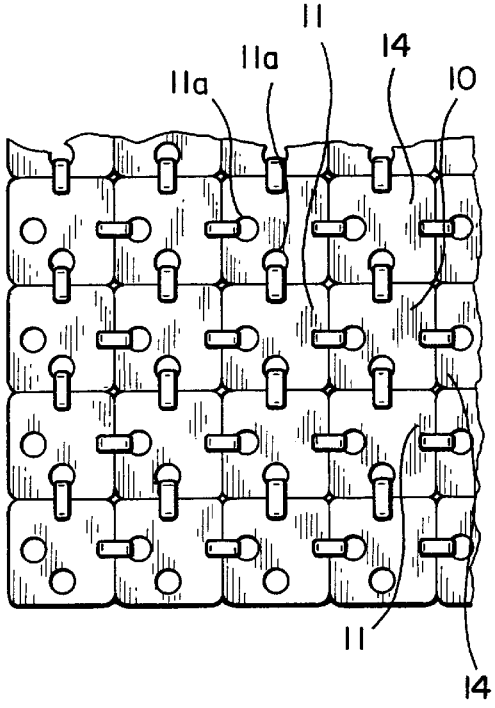
FIG. 5 a view of the fabric from inside.
Figure 6:
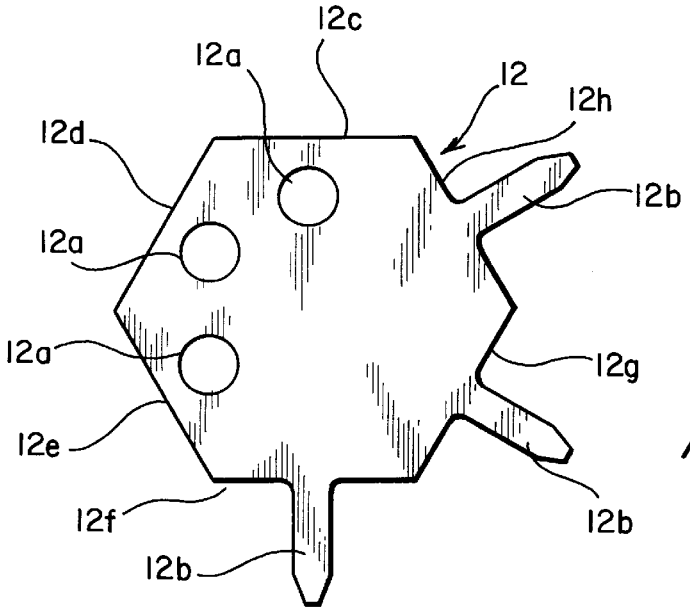
FIG. 6 a further embodiment of a scale.

The fabric according to FIGS. 4 and 5 and referring also to FIGS. 1 and 2, comprises a plurality of interconnected scales, 10, 11, which have bores 10*a*, 11*a*, to connect them to one another and into which the connecting members 10*b*, 11*b*, in the form of connecting arms extend. This fabric can e.g. be used as a pierce-proof fabric since it, as a result of the overlapping, provides increased resistance to being pierced. By this means, this fabric also meets requirements which require that, to qualify fabric as a true pierce-proof fabric, piercing by means of an ice axe or a stickleback is not possible.

The fabric can, however, also be used for other purposes, either with the outer side as per FIG. 4 facing outwards, or with the inner side as per FIG. 5. For example, the fabric can be used in the decorative field, or in the production of metallic fabrics for receptacles such as e.g. bags.

According to FIGS. 2 and 4, the scales are so arranged in rows and columns that they overlap in the manner of roof tiles (forming an imbrication). According to FIGS. 1, 2, 3 and 6, the connecting members 10*b*, 11*b*, 12*b*, 13*b* are formed directly on the scales 10, 11, 12, 13. Because these connecting arms, as per FIG. 2, extend into the bores of the adjacent scales, overlapping arises of its own accord as on a tiled roof. As such, corresponding mobility is nevertheless present, such that the fabric does not hinder the user in his movements.

The scales 10, which are identical in their basic shape, overlap in the fabric at least two adjacent scales 14, (FIG. 5), and are overlapped by at least two scales 11, so that each scale overlaps, or is overlapped, by all adjacent scales. Preferably, the scale has a shape such as is shown in FIG. 1. A connecting arm 10*b* lies diametrically opposite each bore 10*a*. The connecting arm 10*b* is configured as a connecting member 10*b*. The scale itself preferably has an even number of edges 10*c*,10*d*,10*e*,10*f*, or in FIG. 6, 12*c*,12*d*,12*e*,12*f*,12*g*, 12*h*. Some of the edges have a bore 10*a*, 12*a* lying adjacent to one another, and other ones of the edges have at least one connecting member 10*b* formed thereon, with the connecting members also lying adjacent to one another. Thus, the overlapping sides and the overlapped sides lie respectively adjacent to one another. By this means, the desired design in the form of an imbrication is achieved as shown in FIGS. 4 and 5. The scales overlap one another from row to row but also in the respective row.

Figure 3:
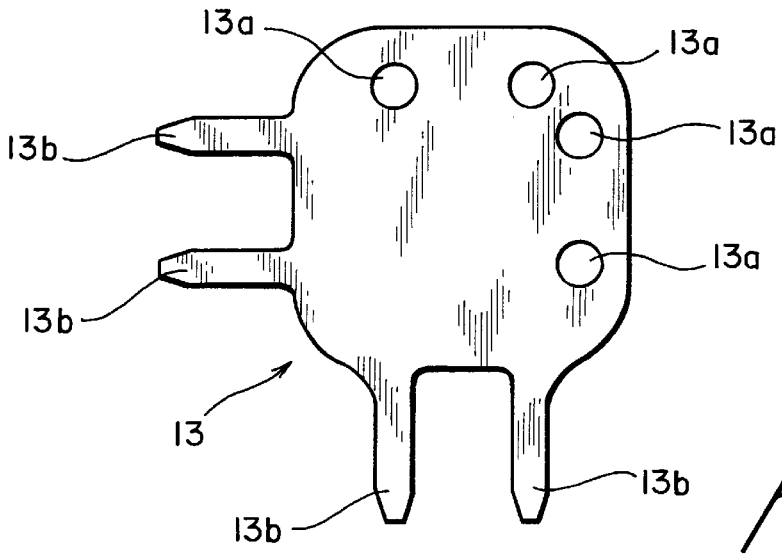
FIG. 3 a further embodiment of a scale.

According to requirements, a design as per FIG. 3 can be undertaken in which on each side of the scale 13 a plurality of bores 13*a* or a plurality of connecting members 13*b* are provided. The individual connecting members can be configured thinner by this means, such that the diameter of the bores 13*a* can be reduced; simultaneously however this leads to a loss in mobility since the members are interconnected more stiffly.

In preferred manner, the basic shape of the scales is, as in FIGS. 1 or 3, a quadrilateral with rounded corners, which is preferably a square. The square shape leads to an optimum arrangement of the scales, since, whilst preserving the same pierce-proof qualities, its mobility in relation to other forms or angular forms is increased, and simultaneously it can be ensured that a complete overlapping takes place. Nevertheless, other shapes are also possible, such as e.g. a hexagonal shape according to FIG. 5, insofar as corresponding overlapping can be ensured. If, however, shapes of this sort are selected and/or the corners are not rounded, earlier locking of the fabric in itself occurs such that mobility is thereby diminished.

FIG. 2 shows the arrangement of the individual scales beside one another. The connecting member 10*b* of the scale 10 grips into bore 11*a* from below, as shown in FIG. 2. The connecting member 10*b* is then bent round and back over the overlapping scale 11 towards the overlapped scale 10. This is continued until the end 10*b*' of the connecting member 10*b* abuts again against the overlapped scale 10.

Basically, any material can be considered for the scales which can be plastically deformed. Synthetics and noble metals are not excluded from this, especially in the decorative field. For protection against piercing, the material should be suitable for repelling corresponding attacks with the scale itself. By preference, the scale is in this case is therefore metallic. To make threading possible, especially with automated manufacture of the material, the ends 10*b*' of the connecting members are pointed and rounded at the end.

It goes without saying that this specification can be subjected to the most varied modifications, alterations and adaptations which move in the region of equivalents to the dependent claims.

What is claimed is:

1. A fabric, comprising a plurality of interconnected scales which have an identical basic shape and bores to connect them to one another, connecting members extending into said bores, which connecting members are directly formed on the scales, wherein the scales overlap one another in the manner of roof tiles (form an imbrication), and in that, in order to make a flat connection, the scale itself in the fabric overlaps at least two adjacent scales and is overlapped by at least two additional adjacent scales, and wherein the scales are disposed side-by-side in respective columns, and in rows, the scales overlapping each other side-by-side and also row-by-row.

2. A fabric according to claim 1, wherein a connecting arm, which is configured as the connecting member, lies substantially diametrically opposite each bore in the scale, on opposite sides of the scale.

3. A fabric according to claim 1, wherein the scales have an even number of edges, wherein at least two adjacent edges each have at least one bore disposed in a region thereof, and at least two further adjacent edges each have at least one connecting member formed thereon.

4. A fabric according to claim 1, wherein at least one of a plurality of bores, and a plurality of connecting members are provided in a region of each edge of the scale.

5. A fabric according to claim 1, wherein a basic shape of the scales is formed by a quadrilateral having rounded corners.

6. A fabric according to claim 5, wherein the quadrilateral is a square.

7. A fabric according to claim 1, wherein the connecting member of the overlapped scale extends into the bore from below and is bent back over the overlapping scale as far as the overlapped scale and abuts against the overlapped scale with an end of the connecting member.

8. A fabric, comprising:

a plurality of interconnected scales, each scale having:

a plurality of edges;

at least one bore disposed in a region of at least one of the edges; and at least one connecting member disposed opposite to the bore in a region of at least a further one of the edges, the at least one connecting member extending into the bore of an adjacent scale, wherein each scale overlaps, or is overlapped by, all adjacent scales.

9. The fabric of claim 8, wherein the bore comprises at least two bores and the connecting member comprises at least two connecting members.

10. The fabric of claim 9, wherein all of the scales have an identical shape.

11. The fabric of claim 10, wherein each connecting member is formed as a connecting arm; and one bore is provided for every connecting arm, each of said bores being substantially diametrical opposed to a corresponding connecting arm.

12. The fabric of claim 10, wherein the scales have a polygonal basic shape.

13. The fabric of claim 12, wherein the connecting arms project from the respective edges of the scale.

14. The fabric of claim 13, wherein the further one of the edges has at least two connecting arms projecting therefrom.

15. The fabric of claim 13, wherein the at least one of the edges having the bore disposed in a region thereof comprises at least two edges adjacent to one another.

16. The fabric of claim 12, wherein the polygonal basic shape has rounded corners.

17. The fabric of claim 12, wherein the polygonal basic shape has an even number of edges.

18. The fabric according to claim 8, wherein the scales are arranged in a plurality of rows and a plurality of columns, with each scale of each row overlapping or being overlapped by an adjacent scale of the same row, and with each scale of each column overlapping or being overlapped by an adjacent scale of the same column.

19. A fabric according to claim 18, wherein each scale of each row is located in alignment with the adjacent scale of the same row, with no intervening space therebetween; and wherein each scale of each column is located in alignment with the adjacent scale of the same column with no intervening space therebetween.

20. The fabric of claim 8, wherein each connecting member of an overlapped scale extends through a respective bore of an overlapping scale from below and is bent to secure the overlapping scale onto the overlapped scale.

21. A fabric according to claim 1, wherein each scale of each row overlaps or is overlapped by all adjacent scales of the same row, and each scale of each column overlaps or is overlapped by all adjacent scales of the same column.

22. A fabric according to claim 21, wherein each scale of each row is located in alignment with the adjacent scale of the same row, with no intervening space therebetween; and wherein each scale of each column is located in alignment with the adjacent scale of the same column with no intervening space therebetween.

23. A fabric according to claim 21, wherein the adjacent scales of the each column are different scales than the adjacent scales of the each row.

24. A fabric according to claim 22, wherein the rows are arranged essentially perpendicular to the columns.

25. A fabric according to claim 22, wherein each of a plurality of the scales are overlapped by, or overlap adjacent scales along all respective edges thereof, so that there are no intervening spaces between the respective adjacent scales.

* * * * *